US008346103B2

(12) United States Patent
Abe

(10) Patent No.: US 8,346,103 B2
(45) Date of Patent: Jan. 1, 2013

(54) DESTINATION DEDICATING APPARATUS, PRINTING APPARATUS, PRINT KIOSK APPARATUS, DESTINATION DEDICATING METHOD, AND PROGRAM

(75) Inventor: Hitoshi Abe, Kanagawa (JP)

(73) Assignee: Sony Corporation, Tokyo (JP)

( * ) Notice: Subject to any disclaimer, the term of this patent is extended or adjusted under 35 U.S.C. 154(b) by 887 days.

(21) Appl. No.: 11/583,549

(22) Filed: Oct. 19, 2006

(65) Prior Publication Data

US 2007/0092269 A1 Apr. 26, 2007

(30) Foreign Application Priority Data

Oct. 21, 2005 (JP) ..... 2005-307885

(51) Int. Cl.
*G03G 15/00* (2006.01)

(52) U.S. Cl. ..... 399/12; 399/9; 399/75

(58) Field of Classification Search ..... 399/9, 12, 399/75

See application file for complete search history.

(56) References Cited

U.S. PATENT DOCUMENTS

| | | | | |
|---|---|---|---|---|
| 6,865,349 | B2 * | 3/2005 | Silence et al. | 399/12 |
| 2004/0101320 | A1 * | 5/2004 | Haramoto | 399/12 |
| 2004/0240893 | A1 * | 12/2004 | Sato et al. | 399/8 |
| 2005/0212891 | A1 * | 9/2005 | Imamura et al. | 347/177 |
| 2005/0286913 | A1 * | 12/2005 | Adkins et al. | 399/12 |
| 2006/0133831 | A1 * | 6/2006 | Rommelmann et al. | 399/12 |
| 2006/0188270 | A1 * | 8/2006 | Chen | 399/12 |
| 2007/0127936 | A1 * | 6/2007 | Miller | 399/12 |
| 2008/0050129 | A1 * | 2/2008 | Clarke et al. | 399/12 |
| 2008/0178170 | A1 * | 7/2008 | Abe et al. | 717/170 |

FOREIGN PATENT DOCUMENTS

| | | |
|---|---|---|
| JP | 2000-355152 | 12/2000 |
| JP | 2001-117743 | 4/2001 |
| JP | 2003-039783 | 2/2003 |
| JP | 2004-268350 | 9/2004 |
| JP | 2005-503937 | 2/2005 |
| JP | 2005-134715 | 5/2005 |
| JP | 2005-140896 | 6/2005 |
| JP | 2005-165011 | 6/2005 |

* cited by examiner

*Primary Examiner* — Ryan Walsh
(74) *Attorney, Agent, or Firm* — Robert J. Depke; Rockey, Depke & Lyons, LLC

(57) ABSTRACT

The present invention provides a destination dedicating apparatus including a destination information reading section and a destination information recording section. The destination information reading section is configured to read destination information from a storage area mounted on a consumable good when the consumable good is first mounted into a printing apparatus. The destination information recording section is configured to record the destination information read above into a storage area provided in the printing apparatus to thereby set the printing apparatus to a dedicated machine for the consumable good having the specific destination information.

7 Claims, 7 Drawing Sheets

DESTINATION DEDICATING APPARATUS, PRINTING APPARATUS, PRINT KIOSK APPARATUS, DESTINATION DEDICATING METHOD, AND PROGRAM

CROSS REFERENCES TO RELATED APPLICATIONS

The present invention contains subject matter related to Japanese Patent Application JP 2005-307885 filed in the Japanese Patent Office on Oct. 21, 2005, the entire contents of which being incorporated herein by reference.

BACKGROUND OF THE INVENTION

1. Field of the Invention

The present invention relates to a technique for automatically setting a printing apparatus to a dedicated machine for a specific destination, and more particularly to a destination dedicating apparatus, printing apparatus, print kiosk apparatus, destination dedicating method, and program therefore adopting the above technique.

2. Description of the Related Art

In general, a printing apparatus is designed so that only specific consumable goods specified by a manufacturing or selling company of the printing apparatus can be used. For example, the printing apparatus is designed so that the shape of the specific consumable goods coincides with the shape of a consumable good mounting space defined in the printing apparatus. In recent years, there has been known a system such that an IC tag is mounted on a consumable good and only when destination information read from the IC tag coincides with destination information prepared in a printing apparatus, this consumable good is determined as an authorized consumable good.

The above system is effective not only in maintaining a print quality, but also in reducing the possibility of malfunction of the printing apparatus.

FIG. 1 shows the concept of the system in related art. An ink cartridge 3 is mounted into a printing apparatus 1 manufactured by Company A. As shown in FIG. 1, there are three kinds of ink cartridges 3 respectively dedicated to Companies A, B, and C. These ink cartridges 3 have the same shape corresponding to the shape of a mounting space defined in the printing apparatus 1, and include IC tags preliminarily storing the respective pieces of destination information. As shown in FIG. 1, only the ink cartridge 3 dedicated to Company A can be mounted into the printing apparatus 1 manufactured by Company A.

A technique for mounting such an IC tag on a consumable good is disclosed in Japanese Patent Laid-open No. 2005-140896, for example.

SUMMARY OF THE INVENTION

For realization of the determination as to whether or not the consumable good (ink cartridge in the case of FIG. 1) to be mounted into the printing apparatus is an authorized product, it is necessary to make a preparation for preliminarily recording information indicating that the printing apparatus is dedicated to Company A. For example, as shown in FIG. 1, firmware dedicated to Company A may be preliminarily installed in the printing apparatus.

However, such dedication of the printing apparatus needs the development and management of the dedicated firmware. Further, it is necessary to make the supply timing of the dedicated consumable good having the destination information coincide with the supply timing of the dedicated firmware.

It is desirable to provide a destination dedicating technique for a printing apparatus, which has following processing functions.

The present invention provides following two processing functions as a destination dedicating technique.

(a) a processing function of reading destination information reading from a storage area mounted on a consumable good when the consumable good is first mounted into a printing apparatus. (b) a processing function of recording destination information read above into a storage area provided in the printing apparatus thereby setting the printing apparatus to a dedicated machine for the consumable good having the specific destination information.

With this configuration, the printing apparatus can be set to a dedicated machine for the consumable good mounted into the printing apparatus by first mounting the consumable good into the printing apparatus. Accordingly, it is not necessary to preliminarily dedicate the printing apparatus to a specific destination.

DETAILED DESCRIPTION OF THE PREFERRED EMBODIMENTS

Some preferred embodiments of the printing apparatus including the dedicating technique according to an embodiment of the present invention will now be described.

In this description, parts not especially shown or described employ known techniques in the related art.

The preferred embodiments described below are merely illustrative and the application of the present invention is not limited to these preferred embodiments.

(A) Destination Dedicating Technique (A-1) Concept of Dedication

Figure 1:
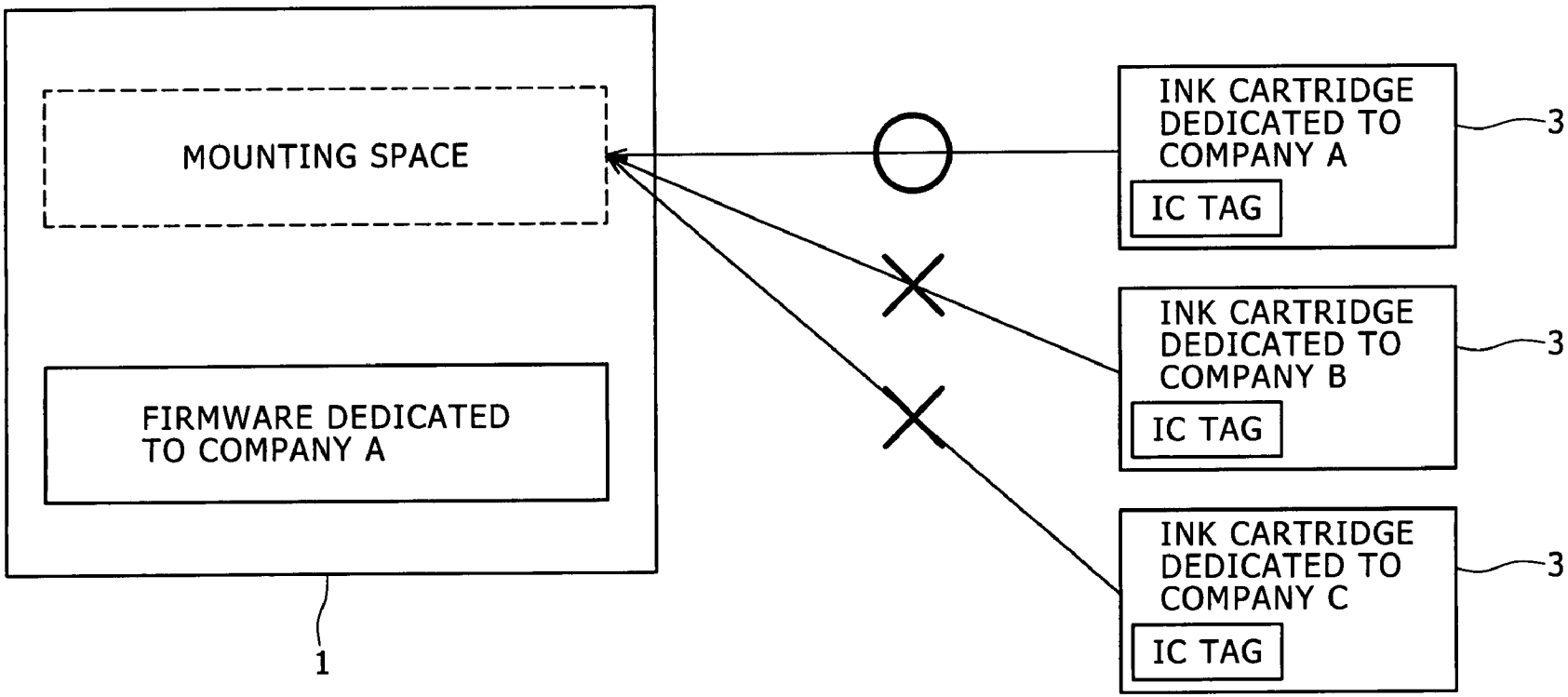
FIG. 1 is a schematic diagram illustrating the related art.
Figure 2A:
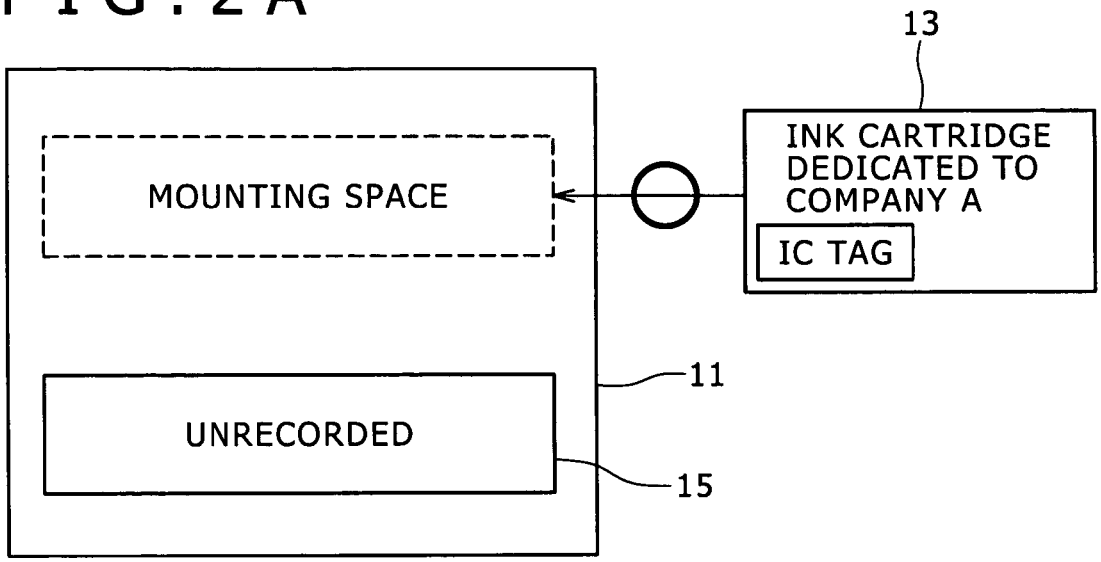
FIGS. 2A and 2B are schematic diagrams illustrating the concept of the destination dedicating technique according to an embodiment of the present invention.
Figure 2A:
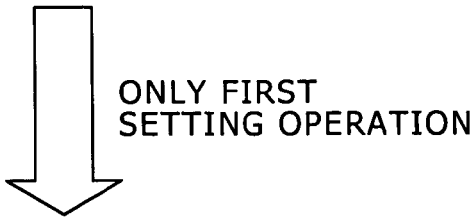
Figure 2B:
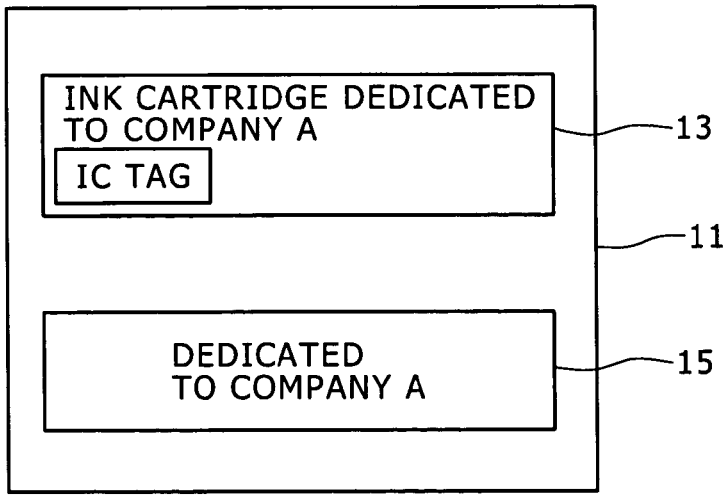

FIGS. 2A and 2B show the concept of the destination dedicating technique according to an embodiment of the present invention. In the case shown in FIGS. 2A and 2B, the consumable good is an ink cartridge, and the printing apparatus is of an ink jet type as a printing type.

This destination dedicating technique can eliminate the dedicating processing and the managing processing in the manufacturing process and the distributing process. The first operation by the user is utilized for the dedication of the equipment.

The embodiment of the present invention utilizes the necessary operation for starting the use of an ink jet printer 11, i.e., the operation of first mounting an ink cartridge 13 into the ink jet printer 11.

As shown in FIG. 2A, a destination information storage area 15 in the ink jet printer 11 remains unrecorded until the ink cartridge 13 is first mounted into the ink jet printer 11.

In the condition shown in FIG. 2A, the ink cartridge authorizing function has not yet been dedicated in the ink jet printer 11 that is manufactured and sold by Company A.

As shown in FIG. 2B, the destination information is recorded in the destination information storage area 15 by first mounting the ink cartridge 13 into the ink jet printer 11. In this condition, the authorization of another ink cartridge 13 can be made.

The recording of the destination information is realized by copying the destination information read from an IC tag mounted on the ink cartridge 13 into the destination information storage area 15.

However, if the ink cartridge 13 does not have a shape corresponding to the shape of the mounting space defined in the ink jet printer 11, this ink cartridge 13 is difficult to be mounted into the ink jet printer 11.

The user that first mounts the ink cartridge 13 into the ink jet printer 11 may be a personal user or a business user. Actually, it is expected that first mounting of any ink cartridge other than the ink cartridge 13 packaged with the ink jet printer 11 by the user is very rare.

Accordingly, by adopting the dedicating technique shown in FIGS. 2A and 2B, the ink cartridge authorizing function of every ink jet printer 11 can be dedicated to Company A through the operation by the user from the viewpoint of social common sense.

(A-2) Functional Configuration

Figure 3:
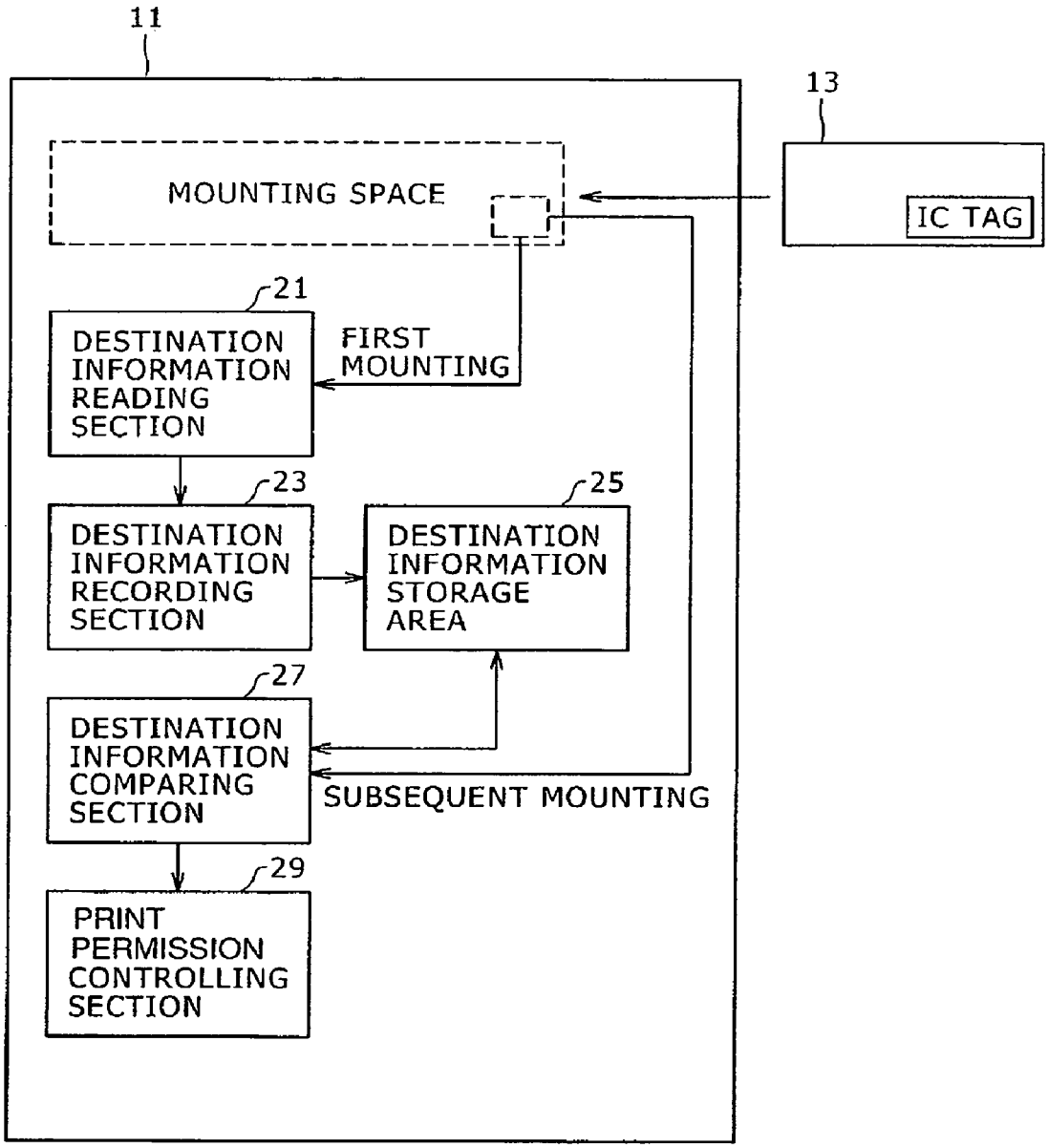
FIG. 3 is a schematic diagram showing a functional configuration in a printing apparatus having the destination dedicating technique according to an embodiment of the present invention.

FIG. 3 shows a functional configuration mounted in the ink jet printer 11. The functional configuration shown in FIG. 3 includes both the processing function as the destination dedicating apparatus and the processing function necessary for the usual operation after recording of the destination information.

The ink jet printer 11 shown in FIG. 3 includes a destination information reading section 21, a destination information recording section 23, destination information storage area 25, a destination information comparing section 27, and a print permission controlling section 29.

The processing function as the destination dedicating apparatus is provided by the destination information reading section 21, the destination information recording section 23, and the destination information storage area 25.

The processing function necessary for the usual operation after recording of the destination information is provided by the destination information storage area 25, the destination information comparing section 27, and the print permission controlling section 29.

The components of each processing function will now be described individually.

The destination information reading section 21 corresponds to a processing function for reading the destination information from the IC tag (storage area) mounted on the ink cartridge 13 when the ink cartridge 13 is first mounted into the ink jet printer 11 by the user.

The destination information recording section 23 corresponds to a processing function for recording the destination information read above into the destination information storage area 25 to thereby set the ink jet printer 11 to a dedicated machine for the ink cartridge 13 having the specific destination information.

The recording of the destination information is realized by copying the destination information stored in the IC tag. Examples of the destination information storage area 25 include a semiconductor memory, hard disk drive, and any nonvolatile storage medium.

The use of such a nonvolatile storage medium provides an advantage such that even when the ink jet printer 11 is powered off, the state of the ink jet printer 11 dedicated to the specific destination can be held.

The destination information comparing section 27 corresponds to a processing function for comparing the destination information read from the IC tag and the destination information recorded in the destination information storage area 25 every time the new ink cartridge 13 is mounted into the ink jet printer 11.

The print permission controlling section 29 corresponds to a processing function for permitting the print using the new ink cartridge 13 mounted in the ink jet printer 11 when the destination information of the new ink cartridge 13 coincides with the destination information recorded. The print permission controlling section 29 also corresponds to a processing function for inhibiting the print using the new ink cartridge 13 mounted in the ink jet printer 11 when the destination information of the new ink cartridge 13 does not coincide with the destination information recorded.

(A-3) Effects of Destination Dedicating Function

The destination dedicating function is mounted in the ink jet printer 11, so that the dedicating processing and the managing processing in the manufacturing process and the distributing process for the ink jet printer 11 can be eliminated.

Further, in the case of OEM (Original Equipment Manufacturer) manufacturing the ink jet printer 11 and providing commonality of main functional configurations except logos or the like on a housing of the ink jet printer 11, it is possible to eliminate the need for developing dedicated firmware for individual purchasers or customers, the need for installing the dedicated firmware, and the need for managing the change in the dedicated firmware.

(B) Other Examples of Printing Apparatus

Figure 4:
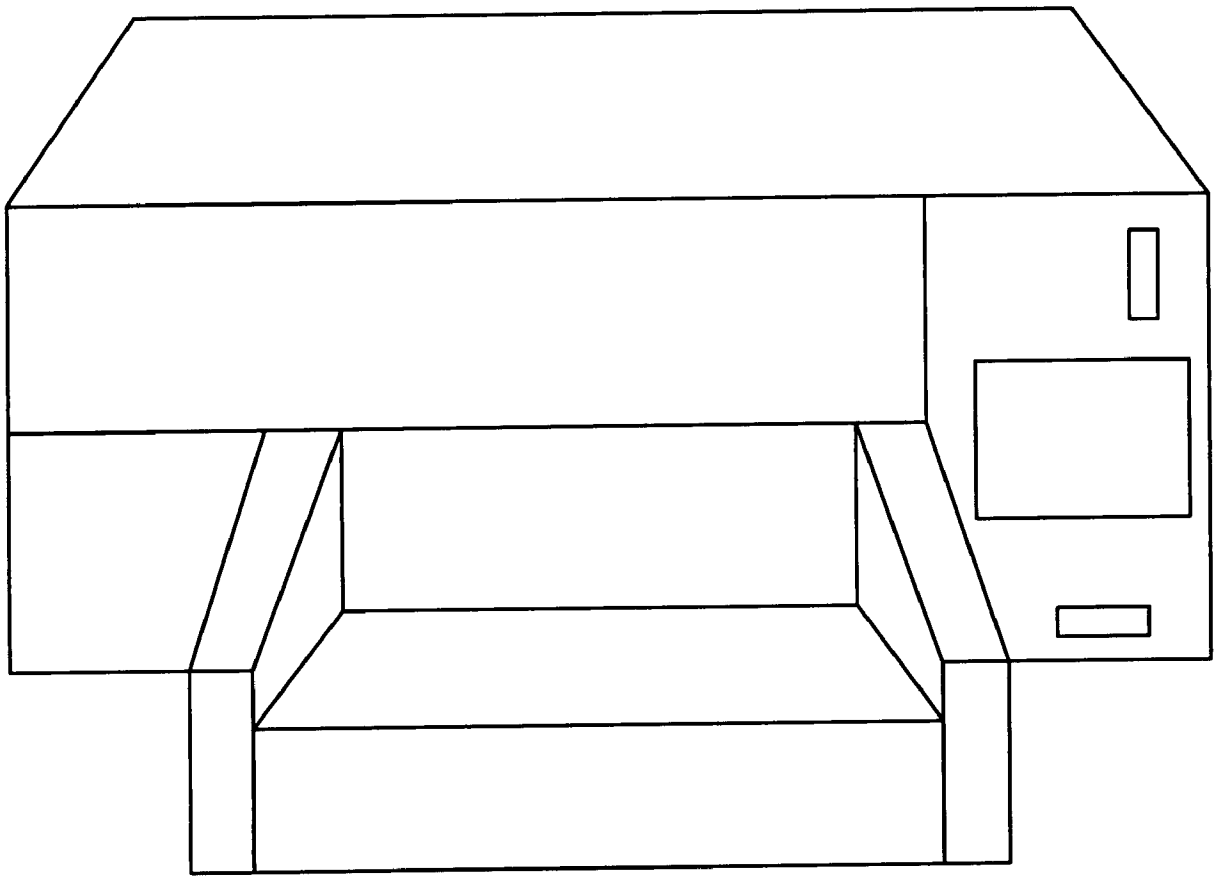
FIG. 4 is a perspective view of an ink jet printer according to an embodiment of the present invention.

The destination dedicating technique mentioned above can be mounted into not only the ink jet printer 11 shown in FIG. 4, but also any other types of printing apparatus.

Figure 5:
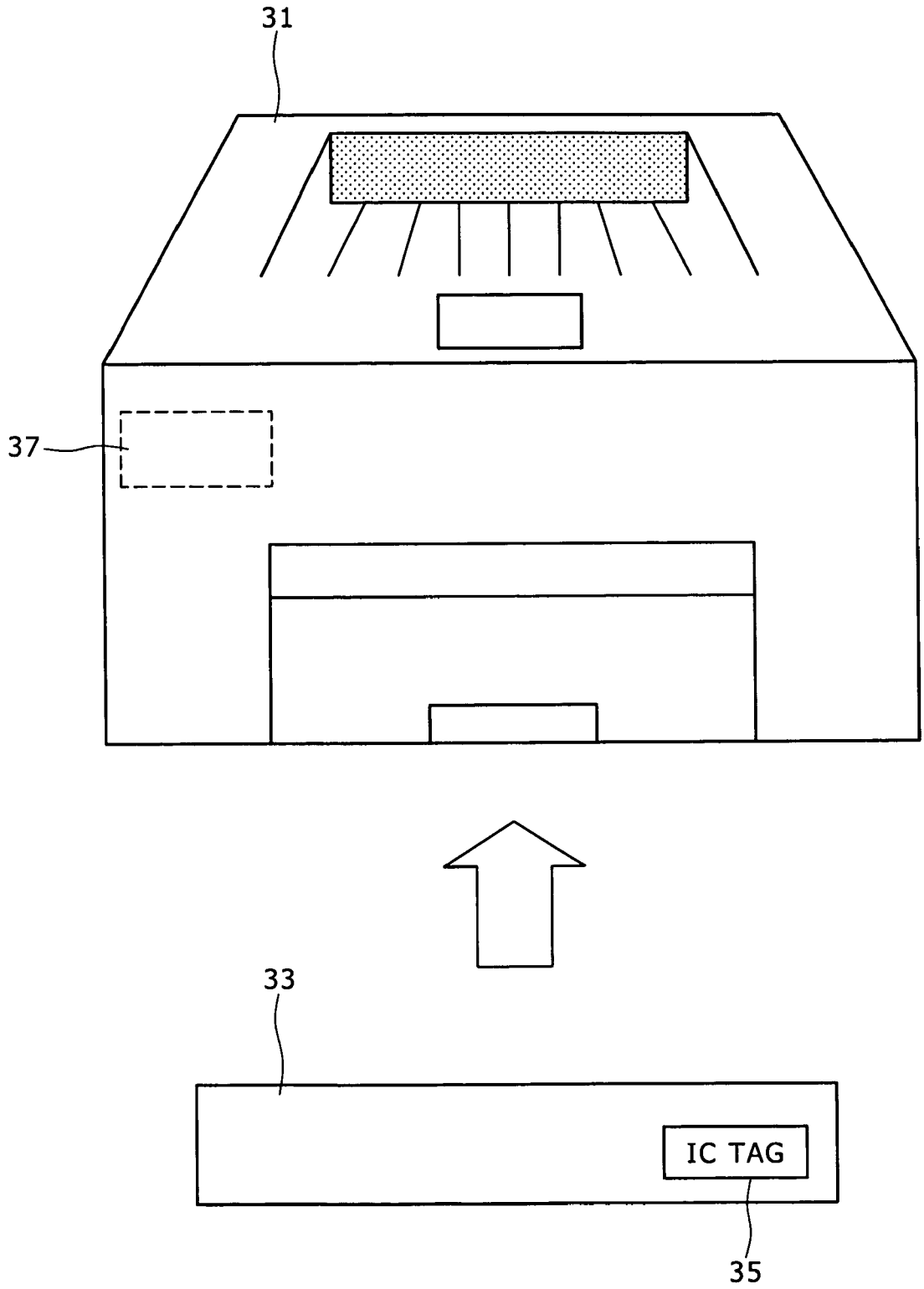
FIG. 5 is a perspective view of a laser printer according to an embodiment of the present invention.

For example, the destination dedicating technique according to an embodiment of the present invention is applicable also to a laser type printing apparatus, or a so-called laser printer. FIG. 5 shows a laser printer 31 to which the present invention is applicable.

As shown in FIG. 5, a toner cartridge 33 having an IC tag 35 is adapted to be mounted into the laser printer 31. As in the ink jet printer 11, the laser printer 31 includes a dedicating circuit 37 for realizing the destination dedicating function shown in FIG. 3. In modification, the destination dedicating function may be realized by software. The destination dedicating technique mentioned above is oriented both to a personal user and to a business user.

For example, the destination dedicating technique according to an embodiment of the present invention is applicable also to a print kiosk apparatus, which is a self-service type printing apparatus capable of printing a photographic image with a high image quality. The print kiosk apparatus is a kind of commercial equipment designed to be placed at a store, on a street, in a specific event place, etc.

Figure 6:
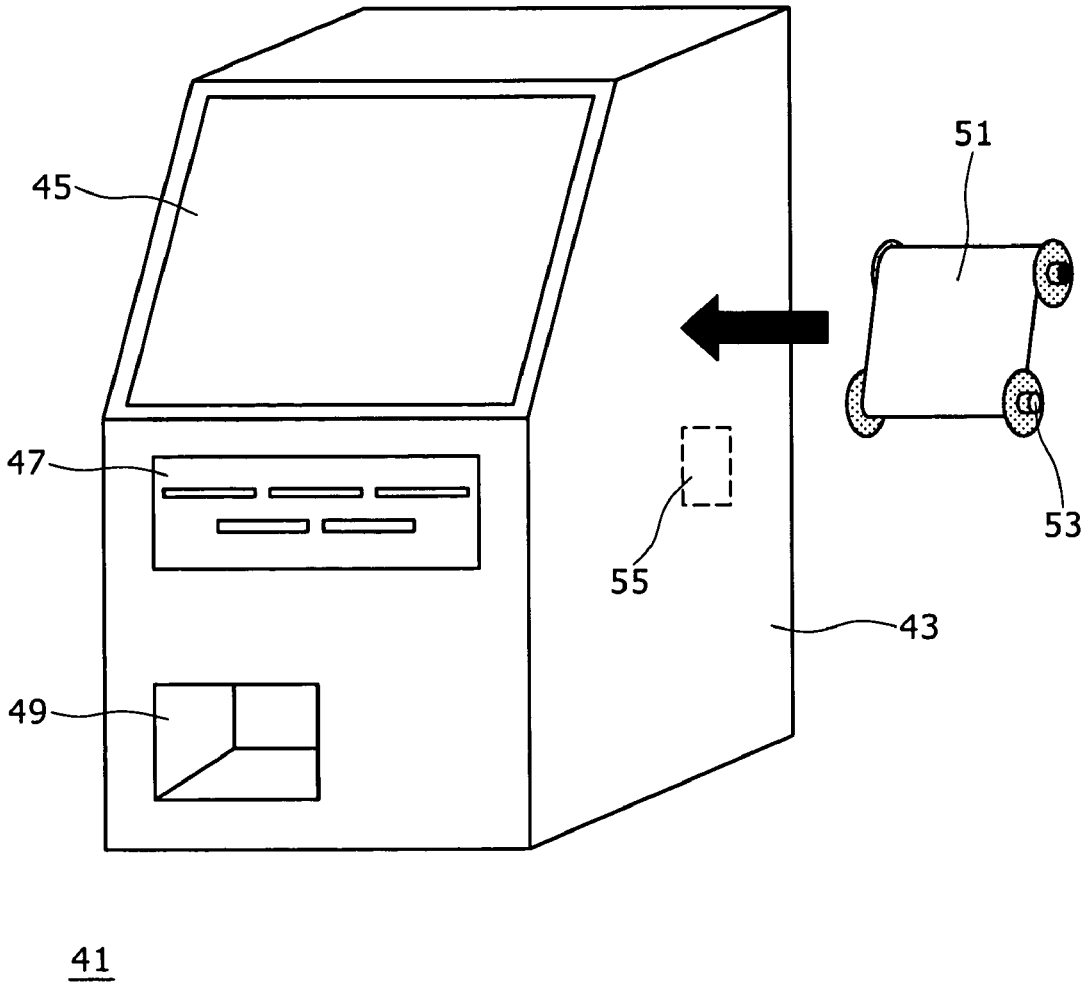
FIG. 6 is a perspective view of a print kiosk apparatus according to an embodiment of the present invention.

FIG. 6 shows a print kiosk apparatus 41 in perspective. The print kiosk apparatus 41 has a box-shaped housing 43 in which a control unit and a thermal head type printing unit are mounted.

In the print kiosk apparatus 41, a touch panel screen 45 is provided at a front upper portion of the housing 43. The touch panel screen 45 has such a structure that a touch panel is provided on the surface of a display screen.

Further, a plurality of slots 47 for insertion of various external storage media are provided at a front central portion of the housing 43. That is, the slots 47 are prepared so as to correspond to the shapes or standards of various portable storage media. Such portable storage media include disk-shaped optical reading type storage media, card-shaped or stick-shaped semiconductor storage media, and magnetic storage media.

Further, a print eject opening 49 is provided at a front lower portion of the housing 43. A printed photo is ejected from the print eject opening 49.

The print kiosk apparatus 41 uses an ink ribbon 51 instead of an ink cartridge and a toner cartridge. The ink ribbon 51 has such a structure that a sublimable material is coated on the surface of a base sheet at a portion corresponding to a print area.

The ink ribbon 51 is provided with an IC tag 53. The ink ribbon 51 is simply mounted into a mounting space defined in the housing 43, thereby obtaining a dedicated machine.

Further, a dedicating circuit 55 for realizing the destination dedicating function is provided as one function of the control unit for controlling the operation of the print kiosk apparatus 41.

(C) Other Embodiments (a) Application to Other Consumable Goods

In the above preferred embodiments, an IC tag is mounted on a cartridge for supplying ink or toner as a consumable good in printing.

However, the consumable good having the IC tag in the present invention is not limited to such a cartridge. For example, a rolled sheet of paper having an IC tag may be applied. The rolled sheet of paper is a long printing sheet rolled on a reel, and it is suitably used for panoramic printing or life-size printing, for example, in the case where an image is difficult to be printed on a cut sheet of paper.

Figure 7A:
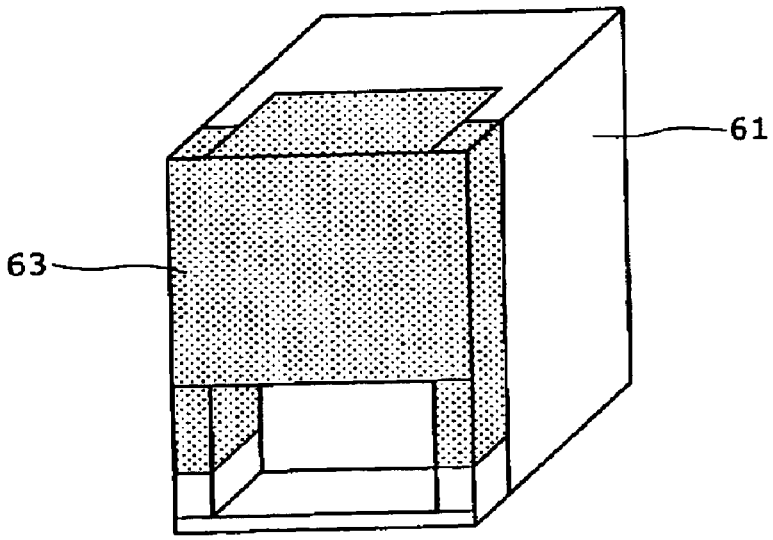
FIG. 7A is a perspective view of a printing apparatus corresponding to consumable goods, which mounts destination information according to an embodiment of the present invention.
Figure 7B:
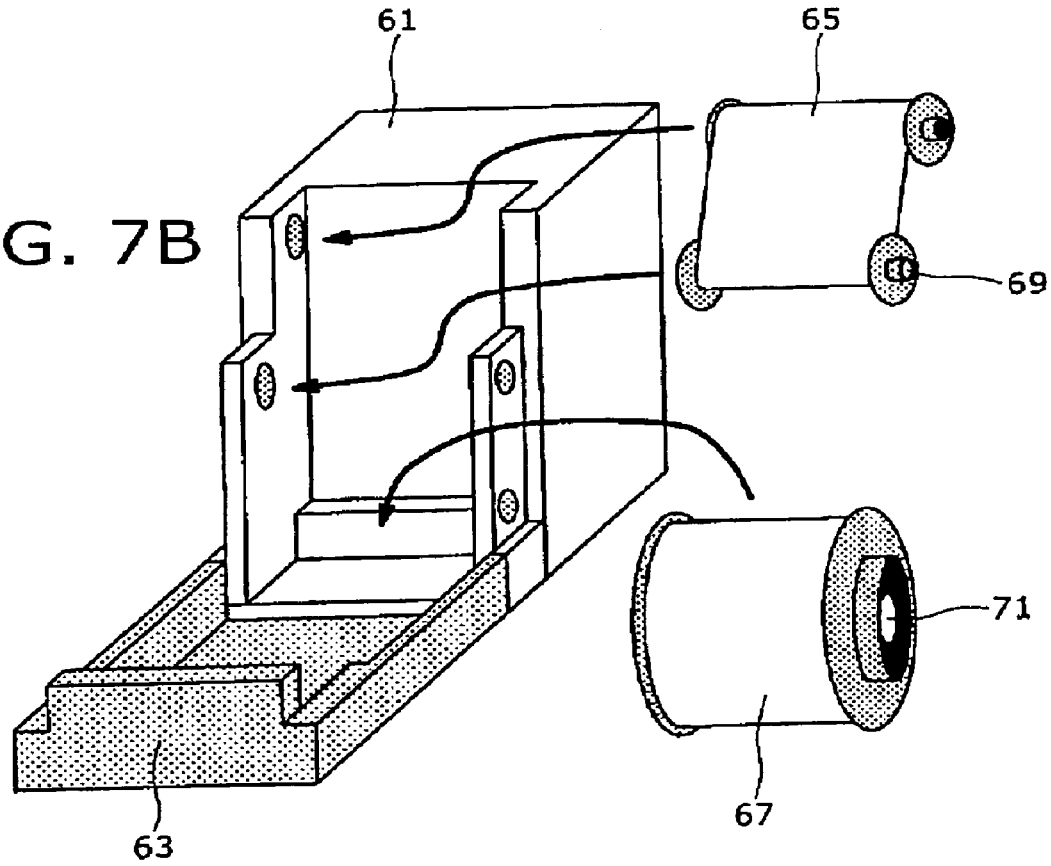
FIG. 7B is a partially exploded perspective view of the printing apparatus of FIG. 7A with a front panel in the open position.

FIGS. 7A and 7B show a thermal head printer as an example of a printing apparatus using a rolled sheet.

A thermal head printer 61 has a front panel 63 adapted to be pivotably opened. In the open condition of the front panel 63, an ink ribbon 65 and the rolled sheet of paper 67 can be mounted and removed.

In this embodiment, IC tags 69 and 71 are also mounted on the ink ribbon 65 and the rolled sheet of paper 67 respectively. These IC tags 69 and 71 preliminarily store destination information.

A reading section configured to read the destination information from these IC tags 69 and 71 is located at such a position that the communication between the reading section and each IC tag can be made.

In such a case that a plurality of consumable goods each having destination information are mounted into a printing apparatus, some destination dedicating methods can be considered.

One of the destination dedicating methods is such that the destination information stored in the first mounted one of the plural consumable goods is adopted. For example, in the case that the ink ribbon 65 is mounted earlier than the rolled sheet of paper 67, the destination information stored in the ink ribbon 65 is adopted.

Another one of the destination dedicating methods is such that the plural pieces of destination information are read from the plural consumable goods, and if these pieces of destination information coincide with each other, the destination information is adopted.

Still another one of the destination dedicating methods is such that the plural consumable goods are dedicated individually or according to kinds. For example, the ink ribbon 65 is dedicated to Company A, and the rolled sheet of paper 67 is dedicated to Company B.

The adoption of any one of the destination dedicating methods depends on user's choice, business patterns, individual contracts, business practices, etc., and therefore it is difficult to be generally decided.

The configuration of mounting the IC tag 71 on the rolled sheet of paper 67 is applicable also to an ink jet printer.

Further, while the IC tag 71 is mounted on the rolled sheet of paper 67 in the case shown in FIGS. 7A and 7B, an IC tag may be mounted on a rolled laminate film for covering the surface of a printing sheet of paper as a kind of consumable good.

(b) Mounting Area for Destination Information

As mentioned above, the destination information is preliminarily stored in an IC tag (IC chip with an antenna in the form of a tag or label) mounted on a consumable good. A noncontact communication technique is utilized to make the communication between the consumable good and the printing apparatus. As another method for reading the destination information from a consumable good, the consumable good may be brought into electrical contact with a printing apparatus to electrically read the destination information from the consumable good.

(c) Examples of Destination Information

The destination information mentioned above includes information for specifying the manufacturing company of the printing apparatus or information for specifying the purchaser of an OEM product.

As another example, the destination information may include information for specifying a country or region of use of the printing apparatus. In this case, the information on the country or region of use of the printing apparatus is stored in the storage area of a consumable good, and by first mounting this consumable good into the printing apparatus, this printing apparatus can be dedicated solely to the recorded country or region so that the use of this printing apparatus is allowed in only the recorded country or region. As a result, it is possible to prevent any trouble in other countries or regions unintended by the manufacturing company or selling company of the printing apparatus.

(d) Software

In the case that the function of dedicating the consumable good mountable into the printing apparatus to a specific destination is realized as a program, this program may be stored in a storage medium to be distributed or may be distributed via a network. Examples of the storage medium include a magnetic storage medium, optical storage medium, and semiconductor storage medium.

(e) Others

Various modifications may be made within the scope of the present invention. Further, various modifications and applications may be made on the basis of the above description of the present invention.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A printing apparatus comprising:

a product company dedication information reading section configured to read product company dedication information from a consumable good the first time when any type of said consumable good is first mounted into said printing apparatus;

a product company dedication information recording section configured to record said product company dedication information into a storage area provided in said printing apparatus to thereby set said printing apparatus to being a dedicated machine that is dedicated to work exclusively with replacement consumable goods having corresponding company dedication information associated with the company corresponding to the consumable good of the type that is first mounted into said printing apparatus by a consumer;

a product company dedication information comparing section configured to compare product company information read from a storage area mounted on said consumable good and said product company dedication information set in said product company dedication information recording section every time a new consumable good is mounted; and a print permission controlling section configured to permit printing using said consumable good mounted in said printing apparatus when said product company dedication information of said consumable good corresponds with said product company dedication information recorded in said printing apparatus and for inhibiting printing using said consumable good mounted in said printing apparatus when said product company dedication information of said consumable good does not correspond with said product company dedication information that is recorded in said printing apparatus.

2. The printing apparatus of claim 1, further wherein the product company dedication information recording section is configured to record said product company dedication information only if product company dedication information read from each of the consumable goods match.

3. The printing apparatus of claim 1, further wherein there is at least one second consumable good having second product company dedication information that is compared by the printing apparatus with stored second product company dedication information before enabling printing using the second consumable good with the printing apparatus only if the second consumable good second product company dedication information matches the stored second product company dedication information.

4. The printing apparatus of claim 3, further wherein the product company dedication information associated with the consumable good and the second product company dedication information of the second consumable good define different product company dedication information.

5. A print kiosk apparatus comprising:

a product company dedication information reading section configured to read product company information from a consumable good when any type of said consumable good is first mounted on the print kiosk;

a product company dedication information recording section configured to record said product company information read from the consumable good that is first mounted on the print kiosk into a storage area provided in said printing apparatus to thereby set said printing apparatus to be a dedicated machine that is dedicated to work exclusively with replacement consumable goods having corresponding product company dedication information;

a product company dedication information comparing section configured to compare product company dedication information read from a storage area mounted on said consumable good and said product company dedication information set in said product company dedication information recording section every time said consumable good is mounted on the print kiosk; and a print permission controlling section configured to permit printing using said consumable good mounted in said print kiosk apparatus when said product company dedication information of said consumable good corresponds with said product company dedication information recorded in the print kiosk and for inhibiting printing using said consumable good mounted in said print kiosk apparatus when said product company dedication information of said new consumable good does not coincide with said product company dedication information recorded in the print kiosk and further wherein there is at least one second consumable good having second product company dedication information that is compared by the print kiosk with stored second product company dedication information before enabling printing using the second consumable good.

6. The print kiosk apparatus of claim 5, further wherein the product company dedication information associated with the consumable good and the second product company dedication information of the second consumable good define different product company dedication information.

7. The print kiosk apparatus of claim 5, further wherein the product company dedication information recording section is configured to record said product company dedication information only if product company dedication information read from each of the consumable goods match.

* * * * *